US008734308B1

(12) United States Patent
Joslin

(10) Patent No.: US 8,734,308 B1
(45) Date of Patent: May 27, 2014

(54) INDOOR YOGA BOARD

(76) Inventor: Hunter Joslin, Melbourne Beach, FL (US)

( * ) Notice: Subject to any disclaimer, the term of this patent is extended or adjusted under 35 U.S.C. 154(b) by 190 days.

(21) Appl. No.: 13/408,613

(22) Filed: Feb. 29, 2012

(51) Int. Cl.
*A63B 22/16* (2006.01)

(52) U.S. Cl.
USPC ..... 482/146; 482/79; 482/142

(58) Field of Classification Search
CPC ..... A63B 22/18; A63B 26/003; A63B 22/16; A63B 2208/0204
USPC ..... 482/34, 51, 71, 79, 121–123, 142–148, 482/908, 910, 75–77; 601/27–32
See application file for complete search history.

(56) References Cited

U.S. PATENT DOCUMENTS

| | | | | |
|---|---|---|---|---|
| 3,287,754 | A | 11/1966 | Price | |
| 3,438,626 | A | 4/1969 | Modla | |
| 3,485,493 | A | 12/1969 | Pitkanen | |
| 3,583,722 | A | 6/1971 | Jacobson | |
| D227,584 | S | 7/1973 | Perez | |
| 3,961,787 | A | 6/1976 | Studebaker | |
| 4,088,325 | A | 5/1978 | Sutton | |
| 4,705,272 | A | 11/1987 | Rupprecht | |
| D303,644 | S | 9/1989 | Upton | |
| 4,911,440 | A * | 3/1990 | Hyman et al. | 482/146 |
| D315,584 | S | 3/1991 | Gappa | |
| 5,643,164 | A | 7/1997 | Teff | |
| 5,730,690 | A | 3/1998 | Guidry | |
| 5,795,277 | A * | 8/1998 | Bruntmyer | 482/146 |
| 5,879,275 | A * | 3/1999 | Aruin | 482/146 |
| 5,888,181 | A | 3/1999 | Yeh | |
| 6,280,366 | B1 | 8/2001 | Hsieh | |
| 6,666,797 | B1 | 12/2003 | Martin | |
| 6,705,977 | B1 | 3/2004 | Ziak | |
| 6,767,313 | B2 | 7/2004 | Sayce | |
| 7,125,373 | B1 | 10/2006 | Garza | |
| 7,632,218 | B2 | 12/2009 | Sannes | |
| D610,638 | S | 2/2010 | Friess | |
| 7,686,751 | B2 | 3/2010 | Carlson | |
| 7,775,952 | B1 | 8/2010 | Curran | |
| 8,512,142 | B2 * | 8/2013 | Meldeau | 463/39 |
| 2002/0151417 | A1 * | 10/2002 | List | 482/123 |
| 2004/0014571 | A1 | 1/2004 | Haynes | |
| 2006/0082089 | A1 | 4/2006 | Rejtano | |
| 2007/0149374 | A1 | 6/2007 | Carlson | |
| 2008/0020856 | A1 | 1/2008 | Rosa | |
| 2011/0098164 | A1 * | 4/2011 | Chang | 482/146 |

OTHER PUBLICATIONS

Orcutt, Indo Boarding, Men's Fitness Magazine, Feb. 2009, pp. 36.
www.indoboard.com, website, retrieved on Feb. 16, 2012, 2 pages.

* cited by examiner

*Primary Examiner* — Loan H Thanh
*Assistant Examiner* — Joshua Lee
(74) *Attorney, Agent, or Firm* — Brian S. Steinberger; Law Offices of Brian S. Steinberger, P.A.

(57) ABSTRACT

Board devices, apparatus, systems and methods for practicing exercises such as yoga and stand up paddling with an elongated planar type board having two half sections joined by a flush mounted hinge, with plural convex curved rocker members mounted underneath the board. A pair of the curved rocker members can abut each other under the hinge to lock the board in an extended position.

19 Claims, 10 Drawing Sheets

INDOOR YOGA BOARD

FIELD OF INVENTION

This invention relates to yoga, in particular to board devices, apparatus, systems and methods for practicing exercises such as yoga and stand up paddling with an elongated planar type board, having two half sections joined by a flush mounted hinge, with plural convex curved rockers underneath the board where a pair of rockers abut each other under the hinge to lock the board in an extended position.

BACKGROUND AND PRIOR ART

Balancing oneself on a pivotable indoor balance board has increased in popularity in recent years. These boards have generally relied on the use of a generally oval shaped board with an underside supported by either an inflatable cushion or a roller type pin. The inventor of the subject invention originally invented the original board in 1975 as a way of practicing surfing on land without having to go in the ocean. In 2004 the inventor introduced an inflatable circular shaped air cushion to be used under the balance board deck as a safety feature as well as an enhanced exercise aspect.

Over the years the popularity of these balancing boards have been used in various classes such as school physical education classes, gym classes, and group exercise programs, as a way of integrating core fitness and balance challenges. Staying on top of the board during unilateral and multilateral movements can increase the heart rate while simultaneously improving balance, upper and lower body joint and muscle strength and a sense of self in space (proprioception), which is important for injury prevention and rehab work. These novel balancing boards can be used to simulate stand up paddling and as a tool for practicing yoga exercises in a limited application.

The introduction of Stand Up Paddling (SUP) as a sport beginning in about 1998 has spawned a new form of exercises and yoga related exercises by using the SUP boards as an unstable platform to perform these exercise while on the surface of any applicable body of water. This in turn created a dry land solution by utilizing SUP boards supported by large balance cushions to simulate the instability of the SUP boards on the waters surface. This new exercise phenomenon is known as SUP yoga and SUP fitness.

There are numerous problems with these existing boards. For example, an SUP board is both difficult to carry and transport from location to location. In addition, these elongated boards take up a considerable amount of storage space that many users do not have. In addition these SUP boards can, as a general rule, only be found in close proximity to a suitable body of water. And are not readily available in large metropolitan areas i.e. New York City, Chicago, Denver, Dallas in relation to the number of practitioners of yoga which leaves a large market segment unable to undertake the new exercise trend.

Additionally, the current types of indoor balance boards have limited movement and versatility in relation to SUP yoga exercises. For example, the existing balance boards are limited in length and do not match the space an adult human requires to properly perform yoga. In addition, the roller pin used underneath the board can result in the board slipping off and easily separating from the roller pin. Thus, the need exists for solutions to the above problems with the prior art.

SUMMARY OF THE INVENTION

A primary objective of the present invention is to provide board devices, apparatus, systems and methods for practicing exercises such as yoga with an elongated planar type board having half sections joined by a flush mounted hinge, with plural convex curved rockers underneath the board, with a pair of rocker abut each other under the hinge to lock the board in an extended position.

A secondary objective of the present invention is to provide foldable board devices, apparatus, systems and methods of using the boards for standup paddling and as a training tool for yoga.

A third objective of the present invention is to provide foldable board devices, apparatus, systems and methods of using the boards to allow users to stand on the boards during training and exercises when the boards are in extended position, and the boards to be easily transported and stored when folded.

A versatile exercise board according to the invention can include an elongated board with an upper flat surface and a lower flat surface, the board having two sides which are each longer than each of a first end and a second end of the board, and a longitudinal axis between the first end and the second end, and a plurality of convex curved rocker members spaced apart and parallel from each other mounted to the lower flat surface of the board, the convex curved rocker members each having a longitudinal axis substantially perpendicular to the longitudinal axis between the first end and the second end of the board, wherein users can practice exercises while standing on the upper flat surface of the board.

The elongated board can be a single solid board.

The elongated board can be a folding board, that can include a flush mounted hinge on the upper flat surface that is approximately midway between the first end and the second end of the board, for allowing half sections of the elongated board to fold with each other. The board can include a pair of convex rocker members mounted to the lower flat surface of the board underneath the flush mounted hinge, each one of the pair being mounted to a half section of the elongated board. A knob can attach each of the pair of convex rocker members together to lock the half sections of the elongated board in an extended position.

A plurality of air cushions can be located underneath the board to adjust rocking motion of the board.

Non-skid strips can attached to the upper surface of the elongated board for enhancing traction. A yoga mat can be draped on the elongated board.

A method of performing exercises in a standup position on an indoor board, can include the steps of providing an elongated board with an upper flat surface and a lower flat surface, the board having two sides which are each longer than each of a first end and a second end of the board, and a longitudinal axis between the first end and the second end, mounting a plurality of convex curved rocker members in a spaced apart and parallel from each other to the lower flat surface of the board, the convex curved rocker members each having a longitudinal axis substantially perpendicular to the longitudinal axis between the first end and the second end of the hoard, and practicing standup exercises on the upper flat surface of the elongated board.

The method can include the step of folding half sections of the elongated board to one another with a flush mounted hinge. The method can include the step of mounting a pair of convex rocker members to the lower flat surface of the board underneath the flush mounted hinge, with each one of the pair being mounted to each of the half sections of the elongated board. The method can include the step of locking the pair of convex rocker members together to maintain the elongated board in an extended position.

The step of practicing exercises can include the step of practicing yoga on the elongated board.

The step of practicing exercises can include the step of practicing stand up paddling on the elongated board.

The step of practicing exercises can include the steps of rocking the board end to end, and/or rocking the board side to side.

The elongated board can include single solid elongated board.

The method can include positioning a plurality of air cushions underneath the single solid elongated board or under the foldable board.

Adjustability of the cushions can include being able slide the air cushions back and forth to adjust the rocking motion of the board.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

A list of components will now be described.

10. Folding Indo Board.
20. Solid Indo Board.
30. Rocker for side to side rocker motion.
40. Optional air cushion increases boards instability.
50. Butler hinge.
60. Folding deck section.
70. Threaded knob.
80. Pressed in nut.
90. Yoga poser.
100. Side to side rocking motion.
110. End to end rocking motion.
120. Wood screw.
130. Solid deck section.
140. Yoga mat.
150. Slide cushions to adjust stability.
160. Optional non-skid strips.

Folding Indoor Board Embodiment

Figure 1:
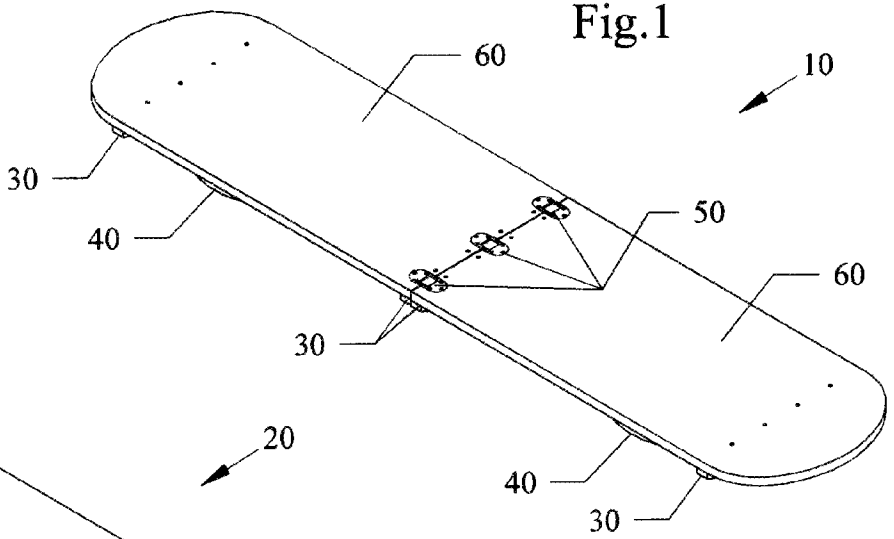
FIG. 1 is a top perspective view of the novel folding indoor board in an extended position.
Figure 3:
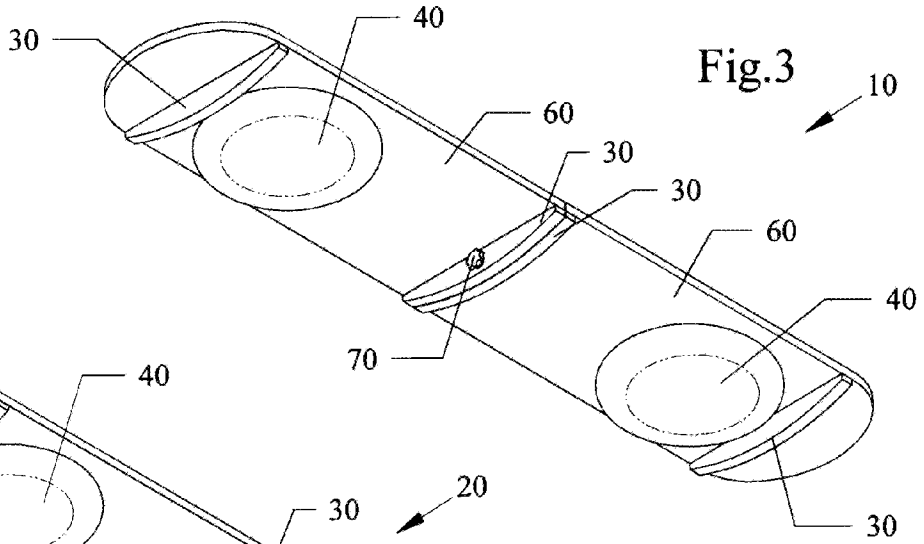
FIG. 3 is a bottom perspective view of the folding indoor board of FIG. 1 with air cushions.
Figure 5:
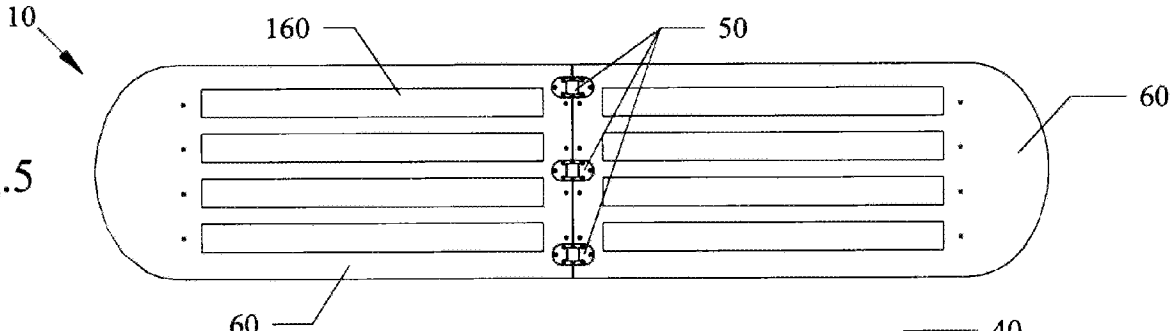
FIG. 5 is a top planar view of the folding indoor board of FIG. 1.
Figure 6:
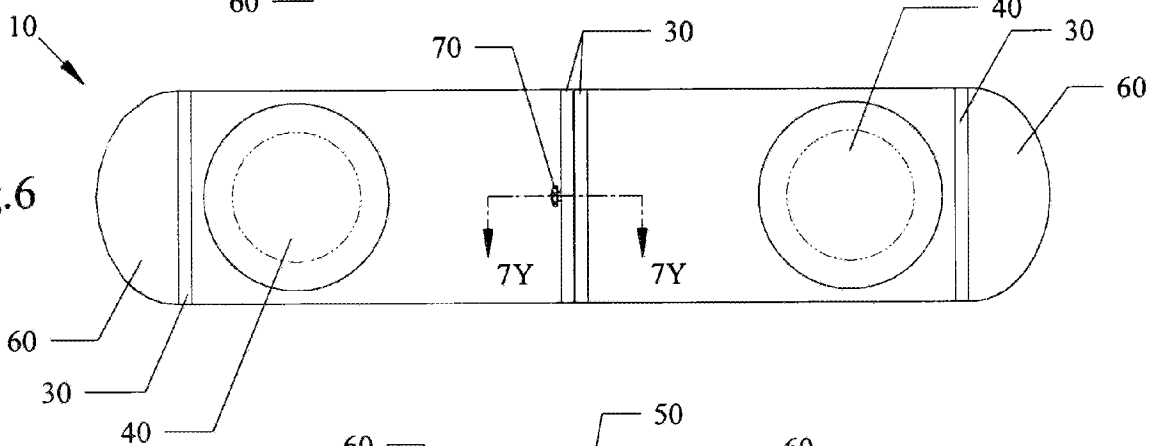
FIG. 6 is a bottom planar view of the folding board of FIG. 3 with air cushions.
Figure 7:
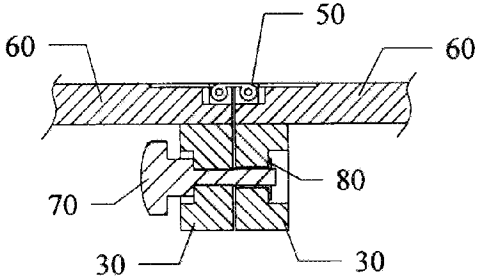
FIG. 7 is a cross-sectional view of folding portion of the indoor board of FIG. 6 along arrows 7Y.
Figure 8:
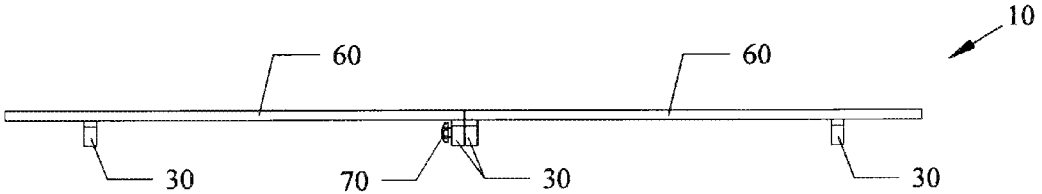
FIG. 8 is a side view of the folding indoor board of FIG. 1.
Figure 9:
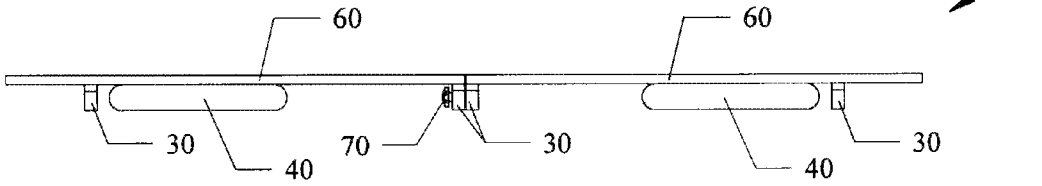
FIG. 9 is a side view of the folding indoor board of FIGS. 3 and 6 with air cushions.

FIG. 1 is a top perspective view of the novel folding indoor board 10 in an extended position. FIG. 3 is a bottom perspective view of the folding indoor board 10 of FIG. 1 with air cushions 40. FIG. 5 is a top planar view of the folding indoor board 10 of FIG. 1. FIG. 6 is a bottom planar view of the folding board 10 of FIG. 3 with air cushions 40. FIG. 7 is a cross-sectional view of folding portion of the indoor board 40 of FIG. 6 along arrows 7Y. FIG. 8 is a side view of the folding indoor board 40 of FIG. 1. FIG. 9 is a side view of the folding indoor board 10 of FIGS. 3 and 6 with air cushions 40.

Referring to FIGS. 1, 3, 5-9, the indoor elongated board can have a general shape of configuration of a surfboard with curved ends and generally long straight sides and have a substantially flat upper surface and a substantially flat lower surface. A plurality of spaced apart parallel convex curved rocker members 30 can be mounted to the lower surface. The rocker members 30 can be mounted in a perpendicular orientation to the longitudinal axis of the elongated board. The rocker members 30 can allow for the elongated board to having a side to side rocking motion.

A flush mounted hinge(s) 50 can be mounted on the upper flat surface that is approximately midway between the first end and the second end of the elongated board 10, for allowing deck half sections 60 of the elongated board to fold with each other. The hinge(s) 50 can be spaced apart butler hinges. Alternatively, the hinge 50 can be a single piano type hinge. When the board 10 is in an extended position a pair of convex rocker members 30 can be mounted to the lower flat surface of the board 10 underneath the flush mounted hinge 50, so that each one of the pair 30 is mounted to a half section 60 of the elongated board. In the extended position the pair of convex rocker members 30 under the hinge 50 abut one another. A screwable type knob 70 can attaches the pair of convex rocker members 30 under the hinge 50 together to lock the half sections 60 of the elongated board 10 in the extended position. The knob 70 can pass through one of the pair of convex rocker members 30 to other side and be threadably attached to a nut type member 80.

Figure 10:
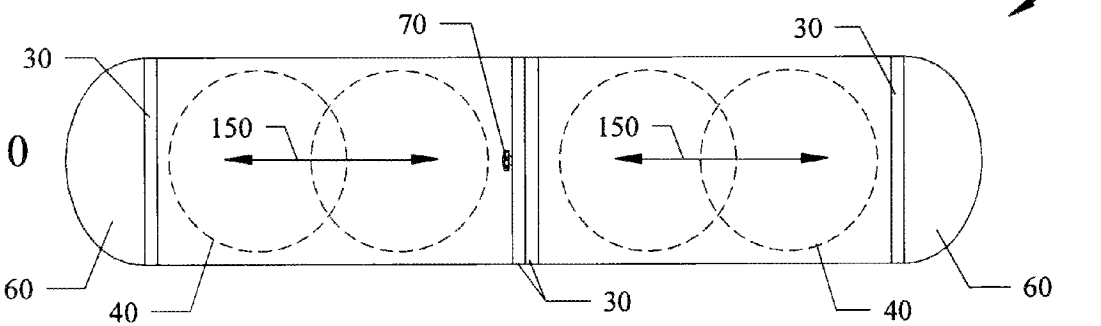
FIG. 10 is a bottom view of the folding board of FIGS. 3 and 6 showing adjustability of air cushions.

FIG. 10 is a bottom view of the folding board 10 of FIGS. 3 and 6 showing adjustability of air cushions 40. Referring to FIGS. 3, 5 and 10, air cushions 50 can be placed underneath the elongated board 10 and generally positioned along outer portions of the half sections 60 adjacent to outer rocker members 30. Sliding the air cushions 40 toward and away from the ends of the board 40 along arrows 160 can adjust the boards 10 stability when a practitioner is in a standup position on the elongated board.

Figure 11:
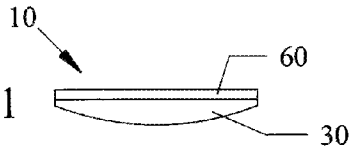
FIG. 11 is an end view of the indoor boards of the preceding figures.
Figure 12:
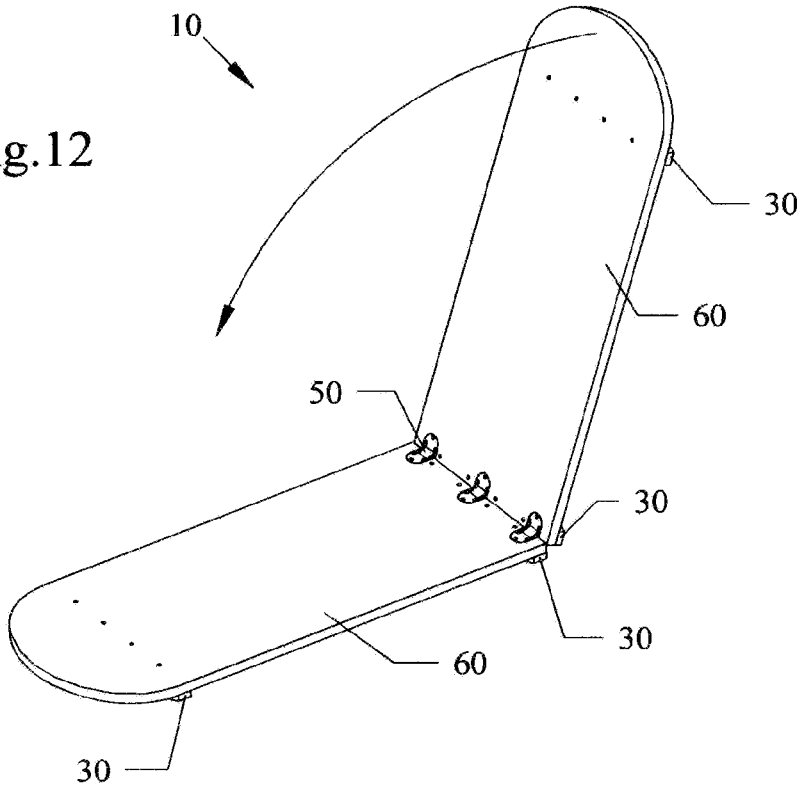
FIG. 12 is a perspective view of the folding indoor board of FIGS. 1 and 5 showing the board in a partially folded position.
Figure 13:
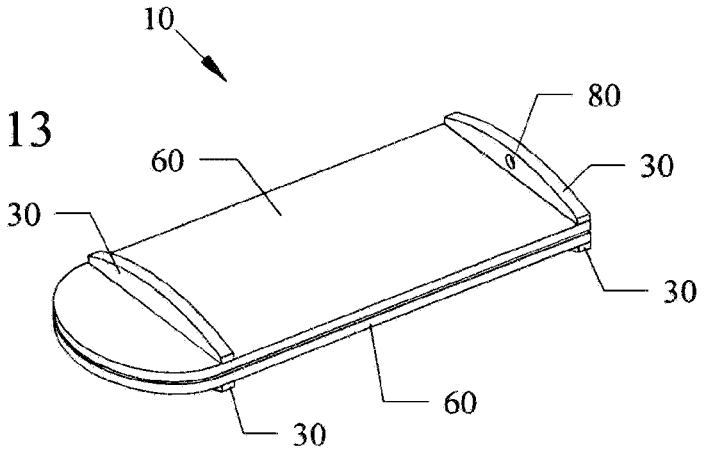
FIG. 13 is a perspective view of the folding indoor board of FIG. 12 showing the board completely folded.
Figure 15:
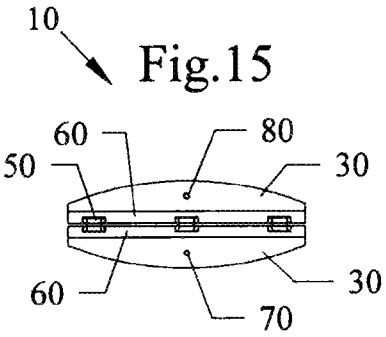
FIG. 15 is a folded end view of the folded indoor board of FIGS. 13-14.
Figure 17:
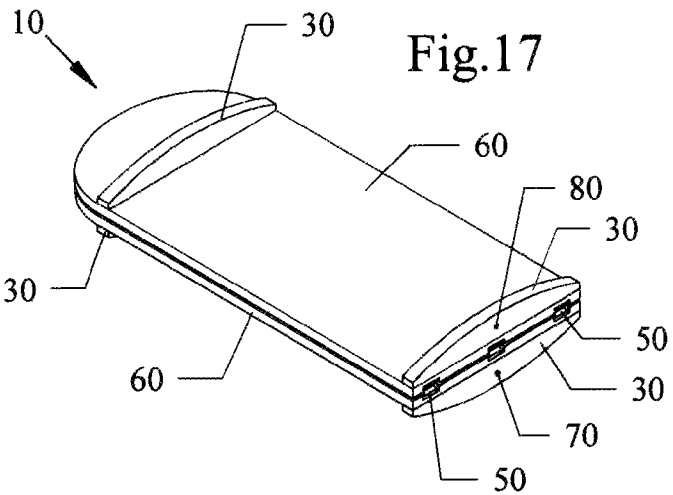
FIG. 17 is a perspective view of the folded indoor board of FIGS. 13-16.
Figure 14:
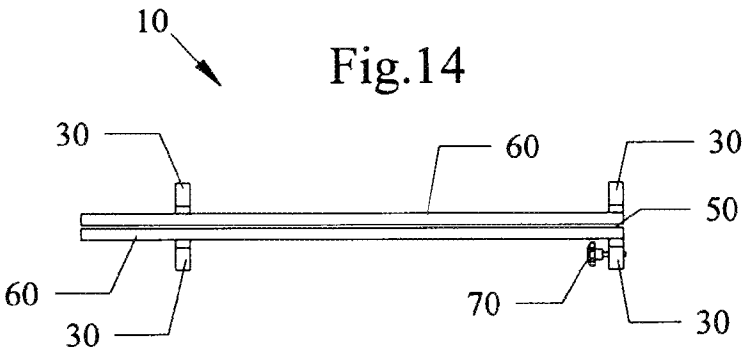
FIG. 14 is a side view of the folded indoor board of FIG. 13.
Figure 16:
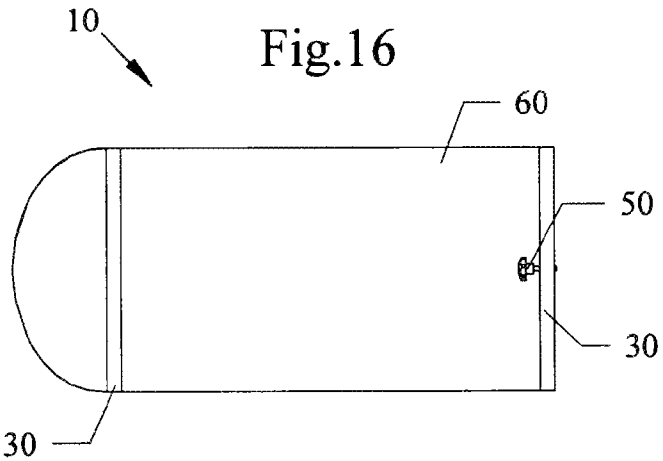
FIG. 16 is a top view of the folded indoor board of FIGS. 13-15.

FIG. 11 is an end view of the indoor boards 10 of the preceding figures. FIG. 12 is a perspective view of the folding indoor board 10 of FIGS. 1 and 5 showing the board 10 in a partially folded position. FIG. 13 is a perspective view of the folding indoor board 10 of FIG. 12 showing the board completely folded. FIG. 14 is a side view of the folded indoor board 10 of FIG. 13. FIG. 15 is a folded end view of the folded indoor board 10 of FIGS. 13-14. FIG. 16 is a top view of the folded indoor board 10 of FIGS. 13-15. FIG. 17 is a perspective view of the folded indoor board 10 of FIGS. 13-16.

Figure 18:
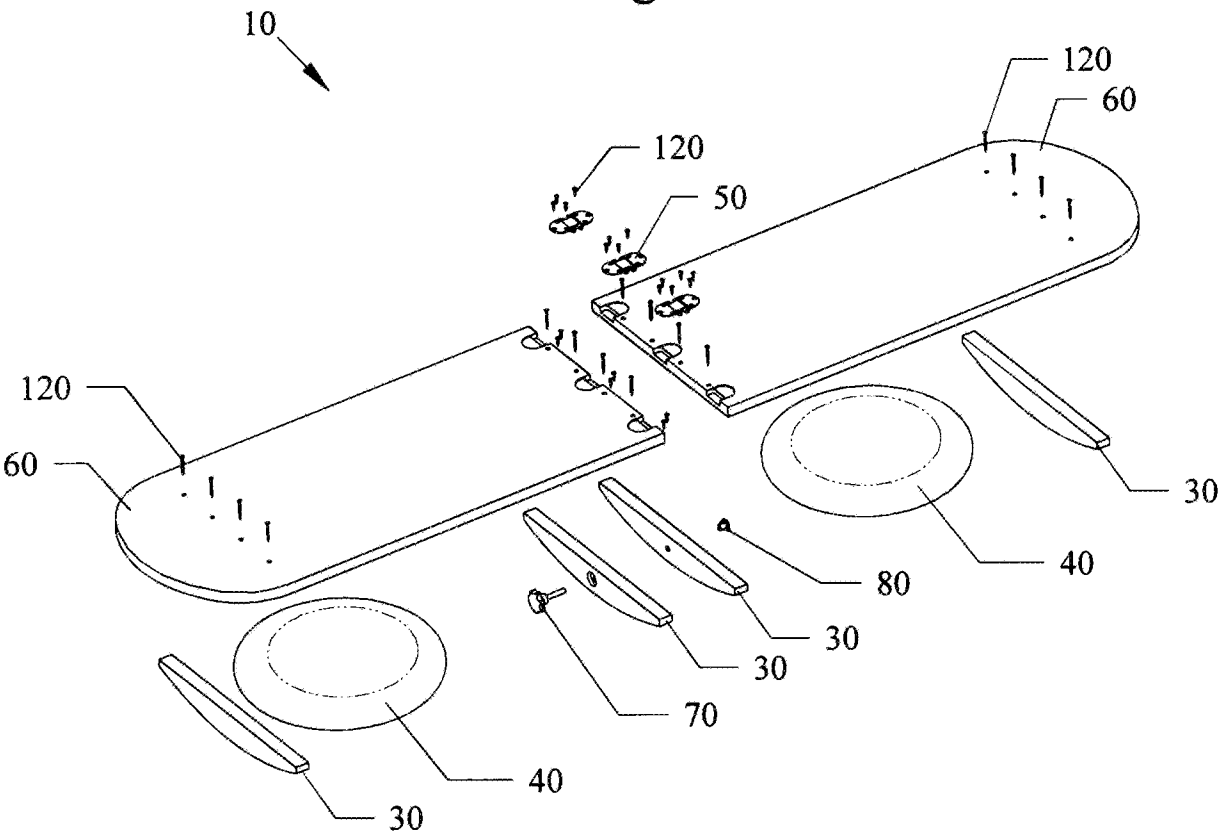
FIG. 18 is a perspective exploded view of the foldable indoor board components of the preceding figures.

FIG. 18 is a perspective exploded view of the foldable indoor board 10 components of the preceding figures. Referring to FIGS. 5 and 18, the upper surface of the board can include a plurality of non-skid strips 160 adhered thereon which allows for greater foot traction for the practitioner standing on the elongated board 10. The rocker members 30 can be mounted underneath the board 10 by fasteners 120 such as screws, and the like. The elongated board 10 can be formed from material such as but not limited to wood, plastic and fiberglass. The convex rocker members 30 can also be molded into the board 20 or half board sections 60 of the foldable board.

Solid Indoor Board Embodiment

Figure 2:
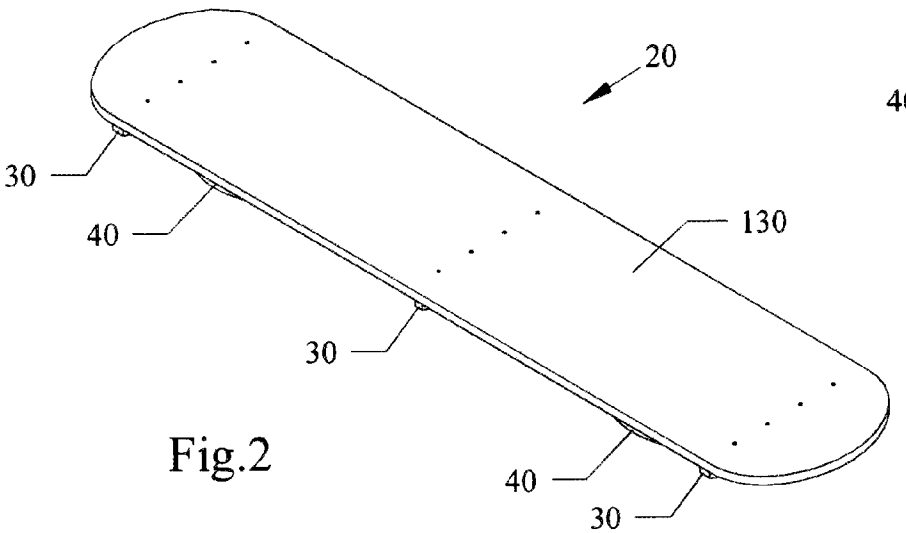
FIG. 2 is a top perspective view a solid indoor board.
Figure 4:
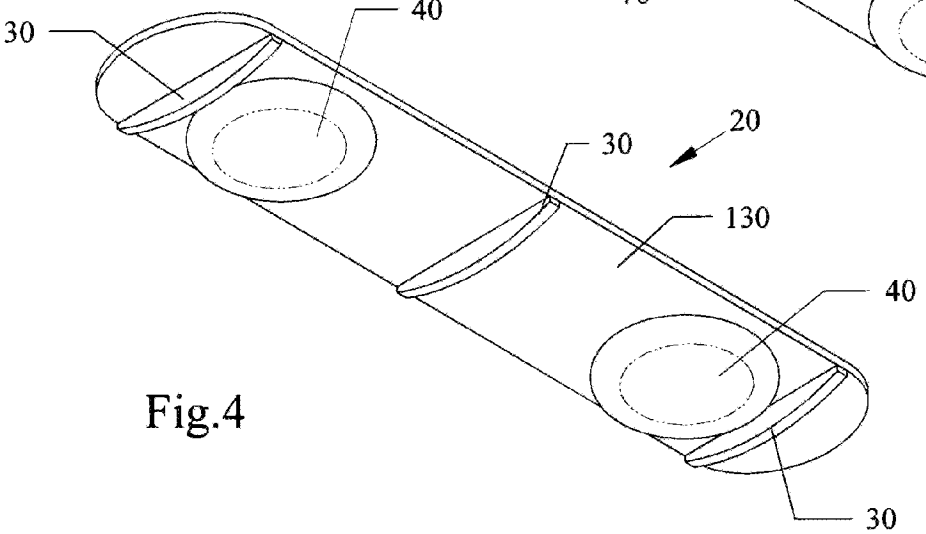
FIG. 4 is a bottom perspective view of the solid indoor board of FIG. 2 with air cushions.

FIG. 2 is a top perspective view a solid indoor board 20 with solid deck section 130. FIG. 4 is a bottom perspective view of the solid indoor board 20 of FIG. 2 with air cushions 40. The indoor board can be used with only the convex curved rocker members mounted underneath the board, and without the folding mechanism of the preceding embodiment.

Standup Exercises

Figure 19:
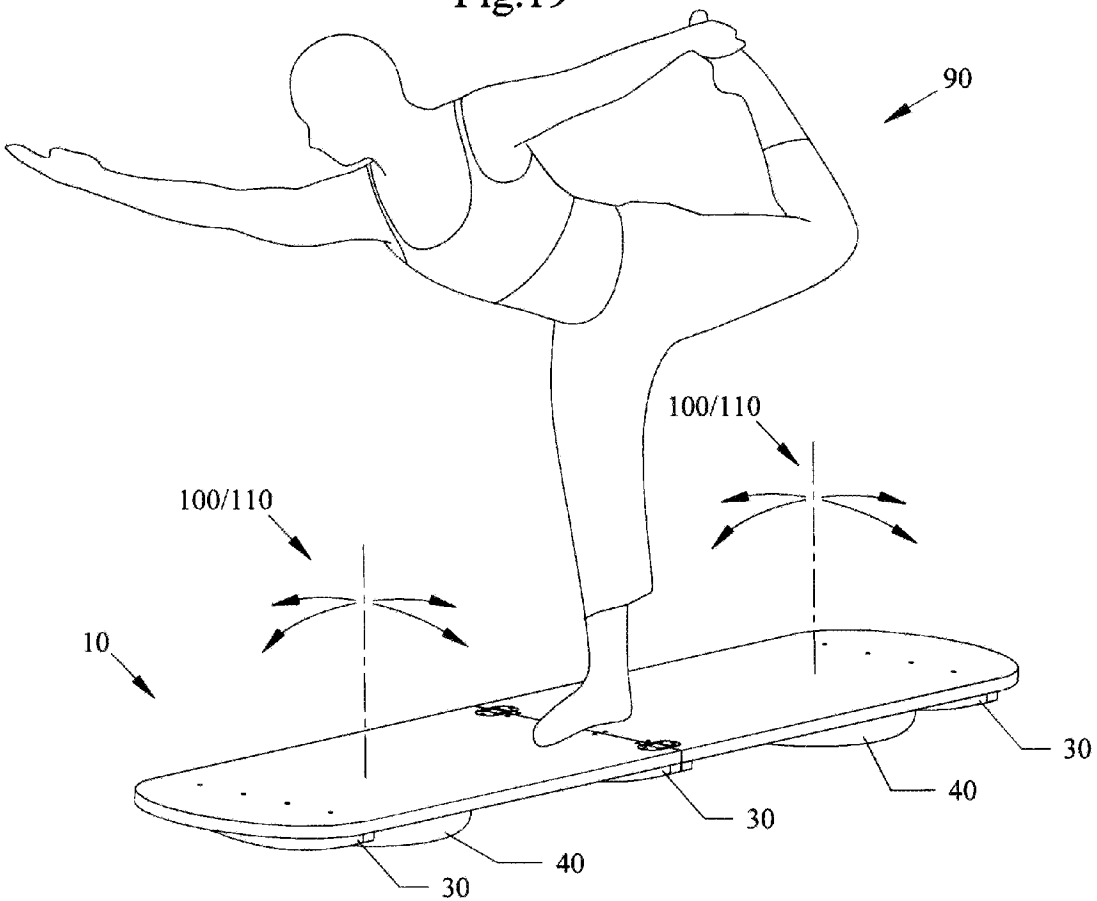
FIG. 19 is a perspective view of a Yoga practitioner using the folded indoor board with air cushions.

FIG. 19 is a perspective view of a Yoga practitioner 90 using the folded indoor board 10 with air cushions 40. Motion indicators 110, 120 show full range of board movement, which can include but is not limited to end to end rocking and side to side rocking.

Figure 20:
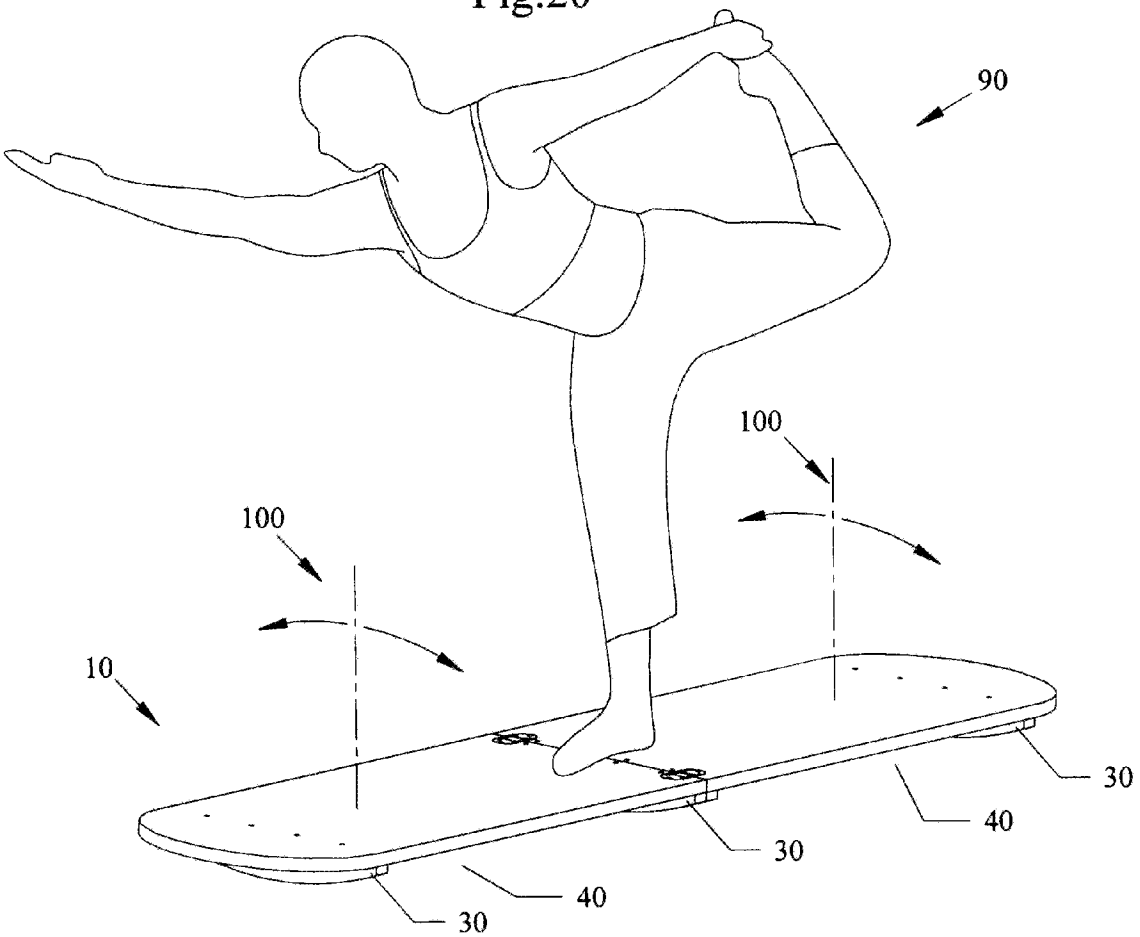
FIG. 20 is a perspective view of the Yoga practitioner using the indoor board without the air cushions.

FIG. 20 is a perspective view of the Yoga practitioner 90 using the indoor board 10 without the air cushions 40. Motion indicators 100 show limited range of movement, which can include side to side only movement.

Figure 21:
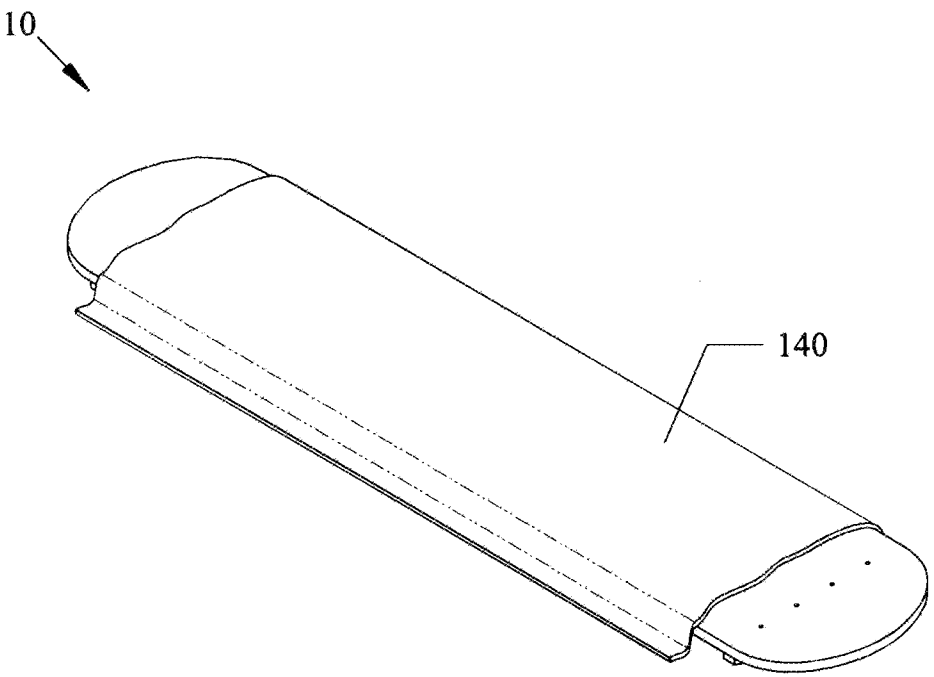
FIG. 21 is a top perspective view of the indoor board of the preceding figures with a yoga mat draped on top.

FIG. 21 is a top perspective view of the indoor board 10/20 of the preceding figures with a yoga mat 140 draped on top.

While the exercises reference Yoga, the user can do other types of standup exercises on the board, such as but not limited to standup paddling exercises, which can replicate standup paddling on water, but done indoors under dry conditions.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A versatile exercise board, comprising:

an elongated board with an upper flat surface and a lower flat surface, the board having two sides which are each longer than each of a first end and a second end of the board, and a longitudinal axis between the first end and the second end;

a first convex curved rocker member mounted to the lower flat surface of the board adjacent to a first end;

a second convex curved rocker member mounted to the lower flat surface of the board substantially midway between the first end and the second end;

a third convex curved rocker member mounted to the lower flat surface of the board adjacent to the second end, each of, each of the convex curved rocker members being parallel to one another, and each of the convex curved members having a longitudinal axis substantially perpendicular to the longitudinal axis between the first end and the second end of the board;

a first air cushion positioned underneath the lower flat surface of the board, between the first convex curved rocker member and the second convex curved rocker panel, and slidably moveable along the longitudinal axis between the first convex curved rocker member and the second convex curved rocker panel; and a second air cushion positioned underneath the lower flat surface of the board, between the second convex curved rocker member and the third convex curved rocker member, and slidably moveable along the longitudinal axis between the second convex curved rocker member and the third convex curved rocker member, wherein the board is adaptable to practice exercises while standing thereon.

2. The versatile exercise board of claim 1, further comprising:

a flush mounted hinge on the upper flat surface that is approximately midway between the first end and the second end of the board, for allowing half sections of the elongated board to fold with each other.

3. The versatile exercise board of claim 2, further comprising:

a pair of convex rocker members mounted to the lower flat surface of the board underneath the flush mounted hinge, each one of the pair being mounted to a half section of the elongated board.

4. The versatile exercise board of claim 3, further comprising:

a knob that attaches the pair of convex rocker members together to lock the half sections of the elongated board in an extended position.

5. The versatile exercise board of claim 1, further comprising:

non-skid strips attached to the upper surface of the elongated board.

6. The versatile exercise board of claim 1, further comprising:

a yoga mat on the upper surface of the elongated board.

7. A method of performing exercises in a standup position on an indoor board, comprising the steps of:

providing an elongated board with an upper flat surface and a lower flat surface, the board having two sides which are each longer than each of a first end and a second end of the board, and a longitudinal axis between the first end and the second end;

mounting a first convex curved rocker member to the lower flat surface of the board adjacent to the first end;

mounting a second convex curved rocker member to the lower flat surface of the board midway between the first end and the second end;

mounting a third convex curved rocker member to the lower flat surface of the board adjacent to the second end, each of, the convex curved rocker members being parallel to one another, each of the convex curved rocker members having a longitudinal axis substantially perpendicular to the longitudinal axis between the first end and the second end of the board;

positioning a first air cushion underneath the lower flat surface of the board between the first convex curved rocker member and the second convex curved rocker member;

positioning a second air cushion underneath the lower flat surface of the board between the second convex curved rocker member and the third convex curved rocker member;

slidably moving the first air cushion along the longitudinal axis of the board between the first convex curved rocker member and the second curved rocker member; and slidably moving the second air cushion along the longitudinal axis of the board between the second convex curved rocker member and the third convex curved rocker member, wherein the steps of slidably moving the first air cushion and the second air cushion increase instability and rocking motion of the board.

8. The method of claim 7, further comprising the steps of:

mounting a pair of convex rocker members to the lower flat surface of the board underneath a flush mounted hinge, with each one of the pair being mounted to each of the half sections of the elongated board.

9. The method of claim 8, further comprising the step of:

locking the pair of convex rocker members together to maintain the elongated board in an extended position.

10. The versatile exercise board of claim 1, wherein each of the first cushion and the second cushion include a generally domed upper surface.

11. The versatile exercise board of claim 10, wherein each of the first cushion and the second cushion include a generally domed lower surface.

12. The versatile exercise board of claim 1, wherein each of the first cushion and the second cushion have a generally disc shaped configuration.

13. The method of claim 7, wherein each of the first cushion and the second cushion include a generally domed upper surface.

14. The method of claim 13, wherein each of the first cushion and the second cushion include a generally domed lower surface.

15. The method of claim 7, wherein each of the first cushion and the second cushion have a generally disc shaped configuration.

16. A versatile exercise board, comprising:

an elongated board with an upper flat surface and a lower flat surface, the board having two sides which are each longer than each of a first end and a second end of the board, and a longitudinal axis between the first end and the second end;

at least three convex curved rocker members, each spaced apart from one another and being parallel with one another and each fixably mounted to the lower flat surface of the board, and each of the convex curved members having a longitudinal axis substantially perpendicular to the longitudinal axis between the first end and the second end of the board;

a plurality of moveable cushions positioned underneath the lower flat surface of the board, each of the cushions being slidably moveable along the longitudinal axis of the board between adjacent curved rocker members, wherein the board is adaptable on which to practice exercises while standing on the upper flat surface of the board.

17. The versatile exercise board of claim 16, wherein each of the moveable cushions include a generally dome shaped upper surface.

18. The versatile exercise board of claim 17, wherein each of the moveable cushions include a generally dome shaped upper surface.

19. The versatile exercise board of claim 16, wherein each of the moveable cushions have a generally disc shaped configuration.

* * * * *